US009677789B2

(12) United States Patent
Joppolo et al.

(10) Patent No.: US 9,677,789 B2
(45) Date of Patent: Jun. 13, 2017

(54) REFRIGERATION APPLIANCE WITH TWO EVAPORATORS IN DIFFERENT COMPARTMENTS

(71) Applicant: Whirlpool Corporation, Benton Harbor, MI (US)

(72) Inventors: Cesare Maria Joppolo, Comerio (IT); Luca Molinaroli, Comerio (IT); Matej Visek, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 528 days.

(21) Appl. No.: 14/010,601

(22) Filed: Aug. 27, 2013

(65) Prior Publication Data

US 2014/0130536 A1 May 15, 2014

(30) Foreign Application Priority Data

Aug. 30, 2012 (EP) ..... 12182353

(51) Int. Cl.

| | |
|---|---|
| ***F25B 7/00*** | (2006.01) |
| ***F25D 11/02*** | (2006.01) |
| ***F25B 40/02*** | (2006.01) |
| ***F25D 11/00*** | (2006.01) |

(52) U.S. Cl.

CPC ..... *F25B 7/00* (2013.01); *F25B 40/02* (2013.01); *F25D 11/006* (2013.01); *F25D 11/022* (2013.01); *F25B 2400/24* (2013.01); *F25B 2600/2511* (2013.01)

(58) Field of Classification Search

CPC ..... F25B 2400/24; F25B 2600/2511; F25B 40/02; F25B 7/00; F25D 11/022; F25D 11/006

USPC ..... 62/335

See application file for complete search history.

(56) References Cited

U.S. PATENT DOCUMENTS

| | | | | | |
|---|---|---|---|---|---|
| 3,768,274 | A | * | 10/1973 | Fink | F25B 41/04 62/159 |
| 4,192,149 | A | * | 3/1980 | Webb | F25D 21/04 62/151 |
| 4,416,119 | A | * | 11/1983 | Wilson | F25B 9/006 62/149 |
| 4,439,996 | A | * | 4/1984 | Frohbieter | F25B 5/04 62/174 |
| 4,513,581 | A | * | 4/1985 | Mizobuchi | F25B 5/04 62/117 |
| 4,949,551 | A | * | 8/1990 | Gregory | F25B 41/04 62/155 |
| 5,231,847 | A | | 8/1993 | Cur et al. | |

(Continued)

FOREIGN PATENT DOCUMENTS

CN 102331134 A 1/2012

OTHER PUBLICATIONS

European Patent Application No. 12182353.8 filed Aug. 30, 2012, Applicant: Whirlpool Europe Srl., Extended European Search Report dated Dec. 17, 2012.

*Primary Examiner* — Kirstin Oswald

(57) ABSTRACT

A refrigerator having a refrigerating circuit with a compressor, a condenser and two evaporators placed in different compartments of the appliance comprises valve means for alternatively directing refrigerant flow towards one of the evaporators. One of the evaporators is in heat exchange relationship with a phase change material.

19 Claims, 3 Drawing Sheets

(56) References Cited

U.S. PATENT DOCUMENTS

| | | | | | |
|---|---|---|---|---|---|
| 5,251,455 | A * | 10/1993 | Cur | F25B 5/02 | 62/199 |
| 5,261,247 | A | 11/1993 | Knezic et al. | | |
| 5,467,812 | A * | 11/1995 | Dean | F24F 5/0017 | 165/62 |
| 5,598,716 | A * | 2/1997 | Tanaka | F25D 16/00 | 62/185 |
| 6,327,871 | B1 * | 12/2001 | Rafalovich | F25B 5/04 | 62/267 |
| 6,931,870 | B2 * | 8/2005 | Kim | F25B 5/04 | 62/198 |
| 2002/0069654 | A1 * | 6/2002 | Doi | F25B 1/10 | 62/199 |
| 2004/0040341 | A1 * | 3/2004 | Jeong | F25B 5/04 | 62/526 |

* cited by examiner

REFRIGERATION APPLIANCE WITH TWO EVAPORATORS IN DIFFERENT COMPARTMENTS

BACKGROUND OF THE INVENTION

The present invention relates to a refrigeration appliance having a refrigerating circuit with a compressor, a condenser and at least two evaporators placed in different compartments of the appliance, a three-way valve being provided for alternatively directing the refrigerant flow towards one of the two evaporators.

SUMMARY OF THE INVENTION

The above kind of refrigerating circuit is also known as "sequential dual evaporator" (SDE) system and allows the design of refrigerators having high energy efficiency.

It is an object of the present invention to further enhance energy efficiency of refrigeration appliances using the SDE cycle. Another object of the present invention is to stabilize temperature in the refrigeration compartment where one of the evaporators is placed.

The above objects are reached tanks to the features listed in the appended claims.

According to the invention, energy consumption improvement is reached by introducing a phase change material (PCM) in contact with the first evaporator inside the refrigeration compartment. According to a preferred embodiment of the invention and additional sub-cooling loop is provided for shifting cooling capacity from refrigeration compartment to freezer compartment. As phase change material any suitable composition can be used which has a liquid-solid phase change temperature below temperature of the refrigeration compartment and high enough to avoid freezing in the refrigeration compartment at minimum load. Example of suitable PCMs can be mixtures of water and glycol or eutectic gels. According to the invention, temperature of the refrigeration compartment becomes more stabilized because of higher thermal capacity of such compartment and therefore an extended ON/OFF period of the compressor is obtained. According to a further preferred embodiment, a second electro valve is used downstream the first in order to avoid additional heat gains of the appliance. Such second electro valve allows decision making when to use a sub-cooling loop or not. The system design according to the invention also offers a possibility of quick defrosting the first evaporator (i.e. the evaporator of the refrigeration compartment).

Further features and advantages according to the present invention will become clear from the following description, with reference to the attached drawings.

DETAILED DESCRIPTION OF THE INVENTION

Figure 1:
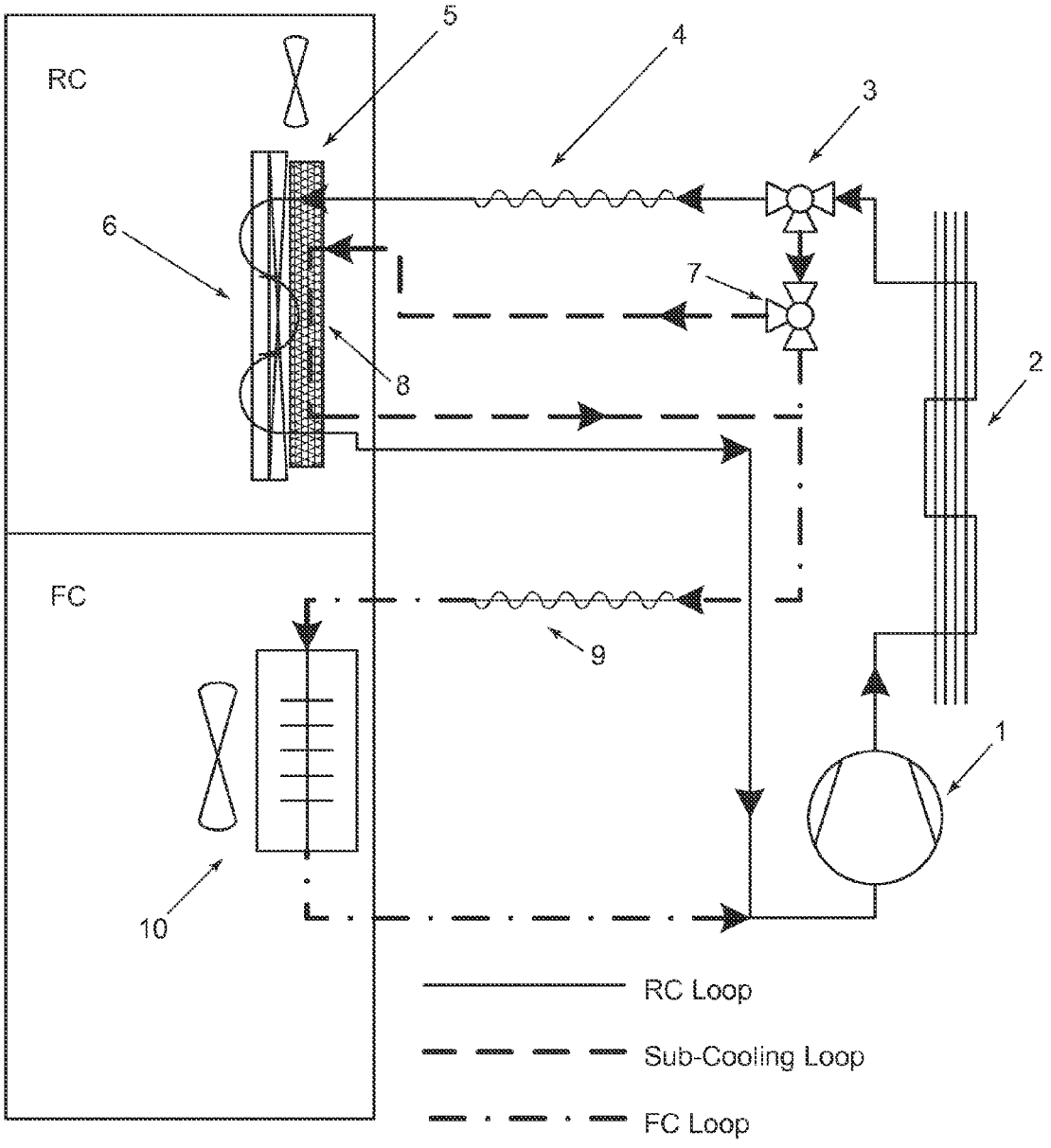
FIG. 1 is a schematic view of the refrigeration circuit according to a first embodiment of the invention.

With reference to FIG. 1, a sequential dual evaporator system is shown with a first evaporator 6 used in the refrigeration compartment RC and a second evaporator 10 used in the freezer compartment FC. System comprises also a shared compressor 1, a condenser 2 followed by a bi-stable electro-valve 3 directing flow either to the first evaporator 6 or to the second evaporator 10. Each evaporator has dedicated capillary tube, respectively 4 for the first evaporator 6 and 9 for the second evaporator 10. Of course any expansion device different from a capillary tube can be used as well. The first evaporator 6 is connected to a reservoir or container 5 of phase change material. During the operation of RC evaporator 6 the PCM 5 is charged. When FC evaporator 10 is switched ON (i.e. by diverting the flow towards the evaporator 10 by means of the electro valve 3) the liquid refrigerant is directly expanded in capillary 9 (in the configuration where the second electro valve 7 does not divert the flow into the sub-cooling loop.

Figure 2:
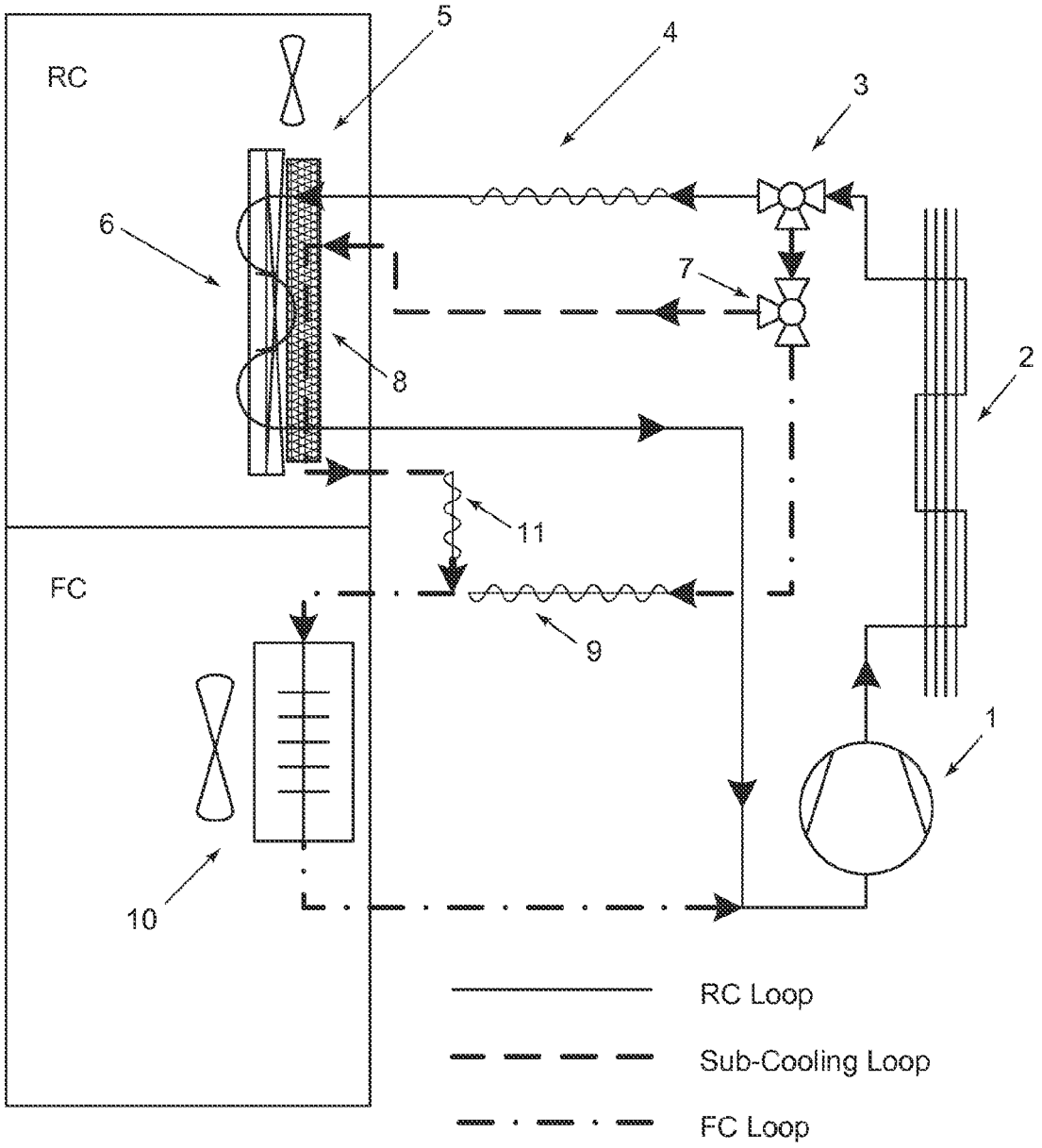
FIG. 2 is a view similar to FIG. 1 and referring to a second embodiment of the invention.
Figure 3:
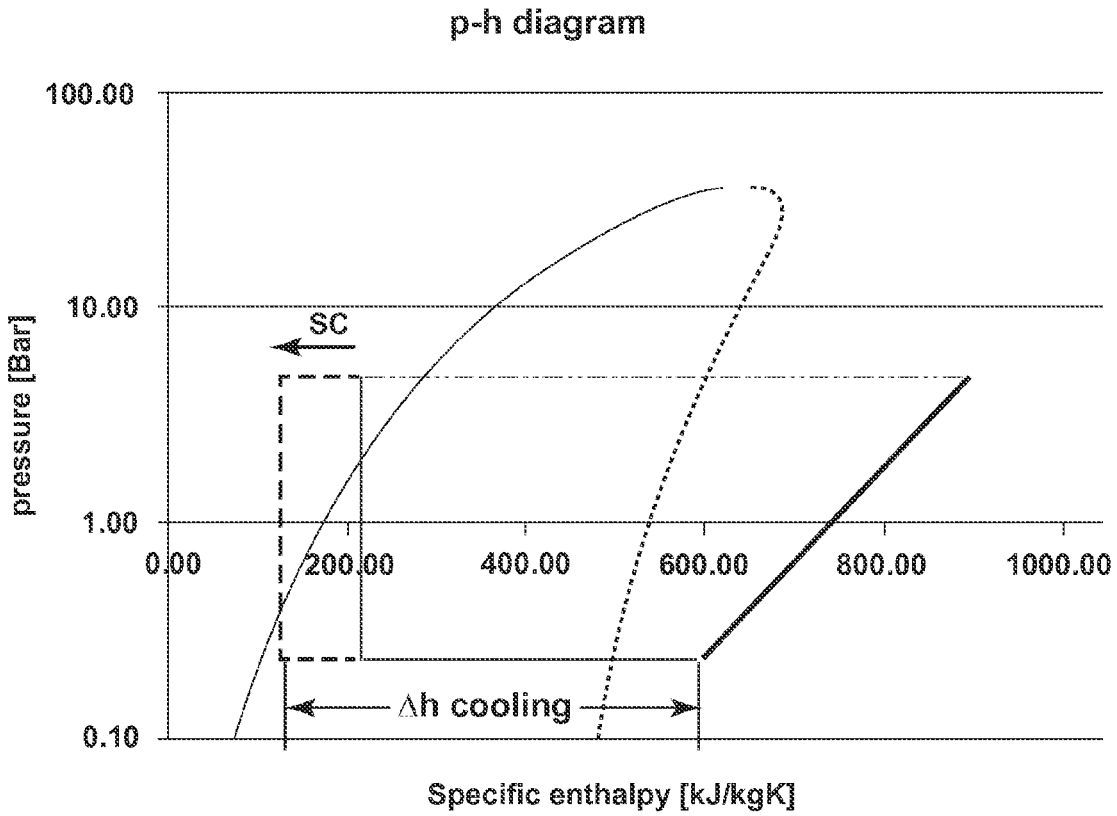
FIG. 3 is a diagram pressure vs. specific enthalpy showing the thermodynamic effect of the sub-cooling according to the invention on the cooling capacity.

It is important to notice that in having a sub-cooling PCM 8 inside of the refrigeration compartment RC additional appliance heat gains from ambient are avoided. Sub-cooling loop enters the refrigeration compartment RC and exchanges heat with PCM in such compartment. The second bi-stable electro-valve 7 is placed on the FC loop to allow switching ON and OFF of the sub-cooling loop. Operation of the loop is decided according to the amount of cooling capacity accumulated in PCM or RC evaporator request for defrost operation. Higher sub-cooling during FC operation results in higher cooling capacity delivered to FC evaporator 10 with the assumption of unchanged refrigerant mass-flow. This gain in cooling capacity is shown in FIG. 3. According to the embodiment shown in FIG. 2, the sub-cooling loop may contain a dedicated capillary tube 11 or any kind of expansion device placed after the PCM reservoir to properly match refrigerant mass-flow rate at high sub-cooling. One of the main advantages of the present invention derives from the PCM contact with the evaporator 6 of the refrigeration compartment RC. This contact improves the global heat transfer coefficient of such evaporator and therefore it allows operation of the RC refrigeration loop at increased evaporator temperatures and increased compressor COP (coefficient of performance). During the RC loop operation, cooling capacity is accumulated in the PCM and continuously released to the refrigeration compartment RC by means of natural convection or a variable speed air fan at a relatively small rate.

In case the PCM in the refrigeration compartment contains a sufficient amount of accumulated cooling capacity, it can be used during the operation of the freezer evaporator 10 to additionally sub-cool liquid by switching ON the sub-cooling loop. Sub-cooling loop can also contain expansion valve (not shown) to partially expand the liquid refrigerant before entering sub-cooling heat exchanger. Increased cooling capacity is delivered to the refrigeration compartment FC, which decreases FC loop time and energy consumption.

Sub-cooling loop acts also as a quick defrost of the evaporator 6 in cases when set phase change temperature is significantly below 0° C. and there is a risk of frost accumulation.

The invention claimed is:

1. A refrigeration circuit for a refrigeration appliance comprising:

a compressor;

a condenser;

a first evaporator associated with a first refrigeration compartment of the refrigeration appliance;

a second evaporator associated with a second refrigeration compartment of the refrigeration appliance;

a phase change material reservoir in heat exchange relationship with the first evaporator;

a first flow directing valve in fluid contact with the first evaporator, a second flow directing valve, and the condenser, the first flow directing valve having a first position and a second position;

the first flow directing valve directs refrigerant flow from the condenser, towards the first evaporator, and blocks flow towards the second flow directing valve when the first flow directing valve is in the first position;

the first flow directing valve directs refrigerant flow from the condenser, towards the second flow directing valve, and blocks flow towards the first evaporator when the first flow directing valve is in the second position;

the second flow directing valve in fluid contact with the first flow directing valve, the second evaporator, and a sub-cooling loop, the second flow directing valve having a bypass position and a non-bypass position;

the second flow directing valve directs refrigerant flow towards the sub-cooling loop and blocks flow through the second flow directing valve towards the second evaporator when the second flow directing valve is in the bypass position;

the second flow directing valve directs refrigerant flow towards the second evaporator and blocks flow towards the sub-cooling loop when the second flow directing valve is in the non-bypass position;

the sub-cooling loop passes refrigerant flow through a portion of the phase change material reservoir prior to passing the refrigerant flow into the second evaporator without passing the refrigerant flow through the first evaporator, and wherein a portion of the sub-cooling loop is in heat exchange relationship with the phase change material reservoir to sub-cool the refrigerant prior to entering the second evaporator.

2. The refrigeration circuit of claim 1, wherein the sub-cooling loop comprises an expansion device upstream from the second evaporator and downstream from the phase change material reservoir.

3. The refrigeration circuit of claim 1 wherein the phase change material reservoir is in a refrigeration compartment.

4. The refrigeration circuit of claim 1 wherein the first evaporator is in a refrigeration compartment.

5. The refrigeration circuit of claim 1, wherein the first flow directing valve comprises a three-way electrically operated valve.

6. The refrigeration circuit of claim 1, wherein the second flow directing valve comprises an electrically operated valve.

7. The refrigeration circuit of claim 1, wherein the second flow directing valve comprises a three-way electrically operated valve.

8. The refrigeration circuit of claim 1, wherein the sub-cooling loop further comprises an expansion device downstream of the phase change material reservoir and upstream of the second evaporator.

9. The refrigeration circuit of claim 1, wherein the sub-cooling loop further comprises an expansion device upstream of the phase change material reservoir.

10. A refrigeration circuit for a refrigeration appliance comprising:

a compressor;

a condenser;

a first evaporator positioned in a first refrigeration compartment of the refrigeration appliance;

a phase change material reservoir positioned adjacent and in thermal contact with the first evaporator;

a second evaporator positioned in a second refrigeration compartment of the refrigeration appliance;

a first valve fluidically connected to the compressor, the first evaporator, and a second valve, the first valve having a first position and a second position;

the first valve directs flow of refrigerant from the compressor, towards the first evaporator, and blocks flow towards the second valve when the first valve is in the first position;

the first valve directs flow of refrigerant from the compressor, towards the second valve and blocks flow of refrigerant towards the first evaporator when the first valve is in the second position;

the second valve fluidically connected to the first valve, a sub-cooling loop, and a capillary tube upstream from the second evaporator, the second valve having a bypass position and a non-bypass position;

the second valve configured to divert flow of refrigerant towards the sub-cooling loop and blocks flow of refrigerant through the second valve towards the second evaporator when the second valve is in the bypass position;

the second valve directs flow of refrigerant towards the second evaporator and blocks flow towards the sub-cooling loop when the second valve is in the non-bypass position;

a portion of the sub-cooling loop positioned in the first refrigeration compartment and being in thermal contact with the phase change material reservoir;

the sub-cooling loop being fluidically connected to the second evaporator; and wherein the sub-cooling loop sub-cools the refrigerant prior to entering the second evaporator.

11. The refrigeration circuit of claim 10, wherein an expansion device is fluidically connected upstream of the first evaporator and downstream from the first valve.

12. The refrigeration circuit of claim 10, wherein the sub-cooling loop further comprises an expansion device downstream of the phase change material reservoir and upstream of the second evaporator.

13. The refrigeration circuit of claim 10, wherein the sub-cooling loop further comprises an expansion device upstream of the phase change material reservoir.

14. A refrigeration circuit for a refrigeration appliance comprising:

a compressor;

a condenser;

a refrigeration evaporator in a refrigeration compartment of the refrigeration appliance, the refrigeration evaporator in thermal contact with a phase change material reservoir;

a freezer evaporator in a freezer compartment of the refrigeration appliance;

a first valve in a refrigerant flow path of between the compressor, a second valve, and the refrigeration evaporator, the first valve having a first position and a second position;

the first valve directs flow of refrigerant from the compressor towards the refrigeration evaporator and blocks flow towards the second valve when the first valve is in the first position;

the first valve directs flow of refrigerant from the compressor towards the second valve and blocks flow of refrigerant towards the refrigeration evaporator when the first valve is in the second position;

the second valve in the refrigerant flow path between the first valve, the freezer evaporator, and a sub-cooling loop, the second valve having a bypass position and a non-bypass position;

the second valve is configured to divert refrigerant flow towards the sub-cooling loop prior to directing the refrigerant flow into the freezer evaporator when the second valve is in the bypass position;

the second valve is configured to direct refrigerant flow towards the freezer evaporator and to block refrigerant flow toward the sub-cooling loop when the second valve is in the non-bypass position; and wherein the sub-cooling loop is fluidically connected between the second valve and the freezer evaporator and in thermal contact with the phase change material reservoir to sub-cool the refrigerant prior to entering the freezer evaporator.

15. The refrigeration circuit of claim 14, wherein the first valve is a three-way electrically operated valve.

16. The refrigeration circuit of claim 15, wherein the second valve is a three-way electrically operated valve.

17. The refrigeration circuit of claim 14, wherein the second valve is a three-way electrically operated valve.

18. The refrigeration circuit of claim 14, wherein the sub-cooling loop further comprises an expansion device downstream of the phase change material reservoir and upstream of the freezer evaporator.

19. The refrigeration circuit of claim 14, wherein the sub-cooling loop further comprises an expansion device upstream of the phase change material reservoir.

* * * * *